US005878454A

United States Patent [19]

Cecchini

[11] Patent Number: 5,878,454

[45] Date of Patent: Mar. 9, 1999

[54] REVOLVING SUNNING BED

[76] Inventor: Alfredo Cecchini, Strada del Campaccio N. 1, Cailungp, San Marino

[21] Appl. No.: 971,283

[22] Filed: Nov. 17, 1997

[30] Foreign Application Priority Data

Nov. 15, 1996 [IT] Italy ..... B096A0584

[51] Int. Cl.[6] ..... A47C 20/00; A47G 9/00

[52] U.S. Cl. ..... 5/656; 5/419; 5/308; 5/414

[58] Field of Search ..... 607/81, 95; 5/284, 5/414, 417, 419, 656, 308

[56] References Cited

U.S. PATENT DOCUMENTS

| | | | |
|---|---|---|---|
| 2,956,290 | 10/1960 | Scheinerman | 5/308 |
| 3,646,896 | 3/1972 | Derujinsky et al. | 5/419 |
| 4,379,588 | 4/1983 | Speice | 607/95 X |
| 4,441,220 | 4/1984 | Peterson | 5/656 |
| 4,928,332 | 5/1990 | Ogden et al. | 5/308 X |
| 5,320,405 | 6/1994 | Foster et al. | 5/414 X |
| 5,479,668 | 1/1996 | Cooper | 5/656 |

*Primary Examiner*—Michael F. Trettel
*Attorney, Agent, or Firm*—Dvorak & Orum

[57] ABSTRACT

The present invention relates to a revolving sunning bed, comprising a fixed support base, a revolving platform and means of mutual constraint which allow the platform to revolve with respect to the support base. To make it more comfortable to impart motion to the platform, the bed further comprises a motor-driven device and a related command and control device, accessible even while lying down.

11 Claims, 3 Drawing Sheets

FIG. 2
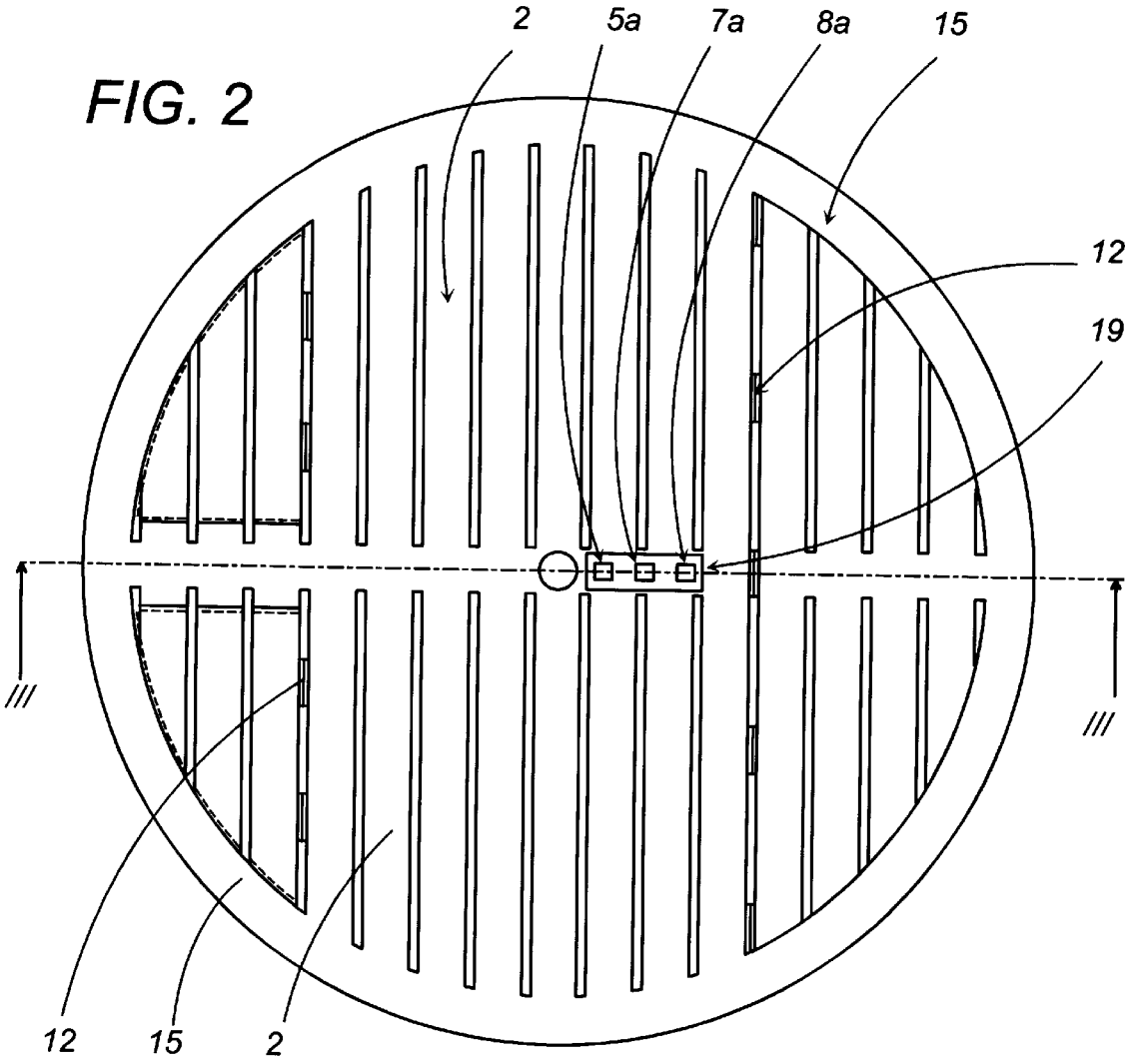
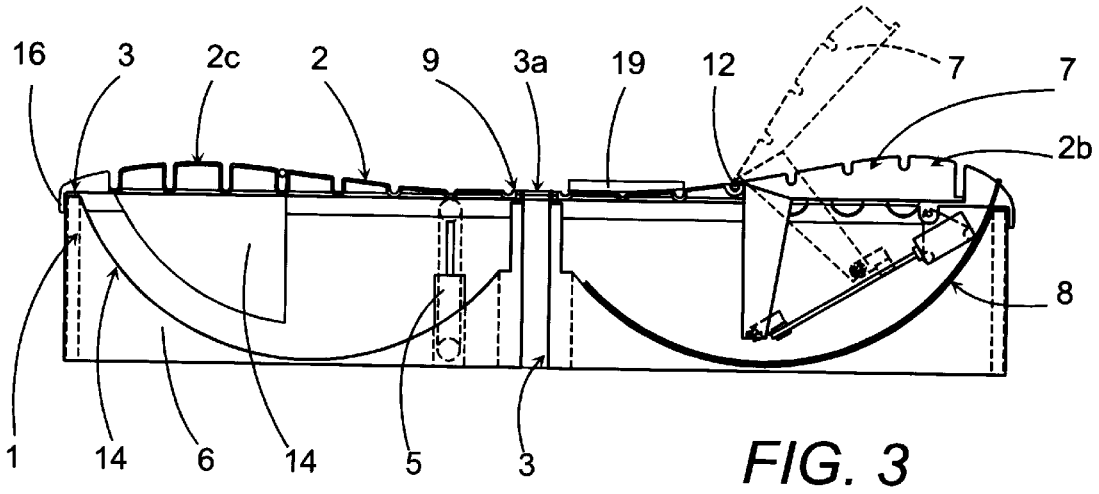
FIG. 3

FIG. 5
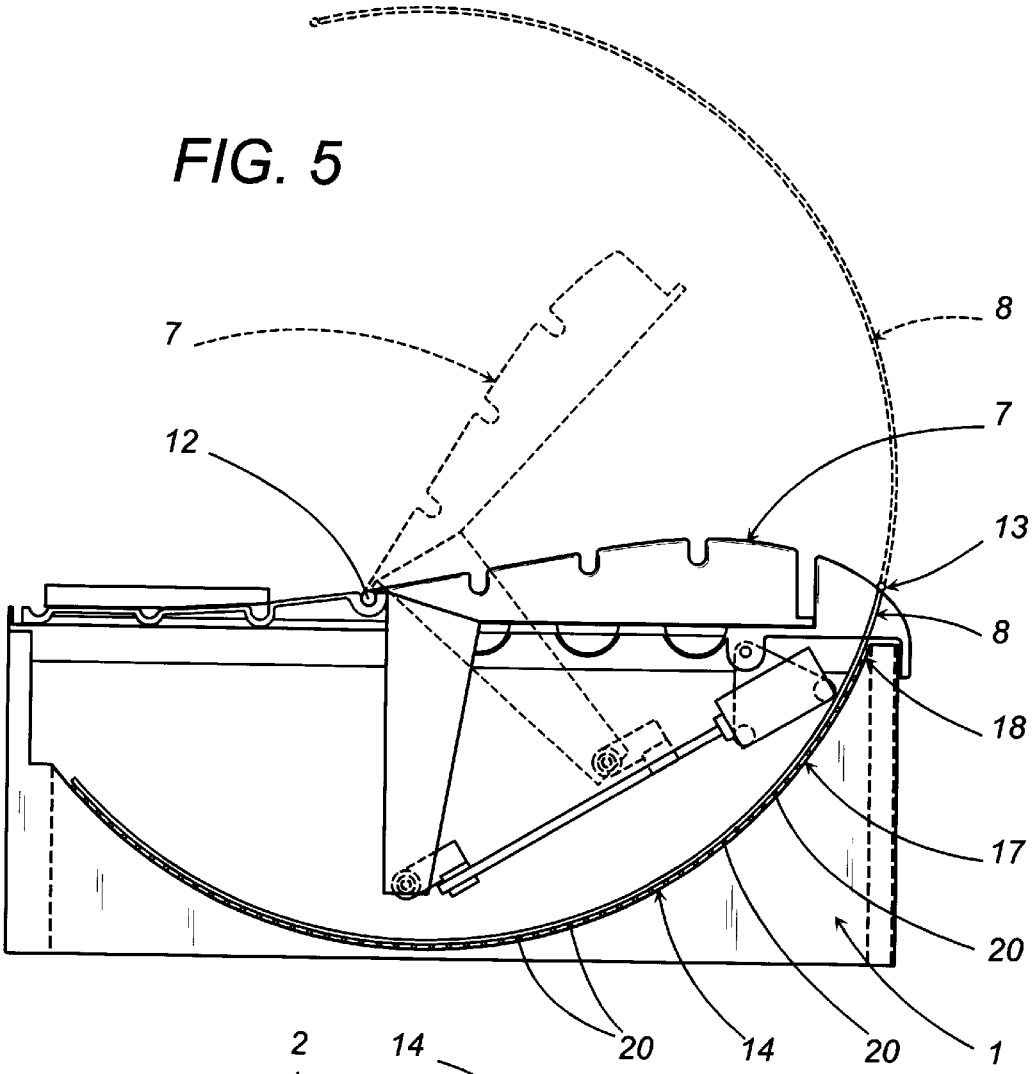
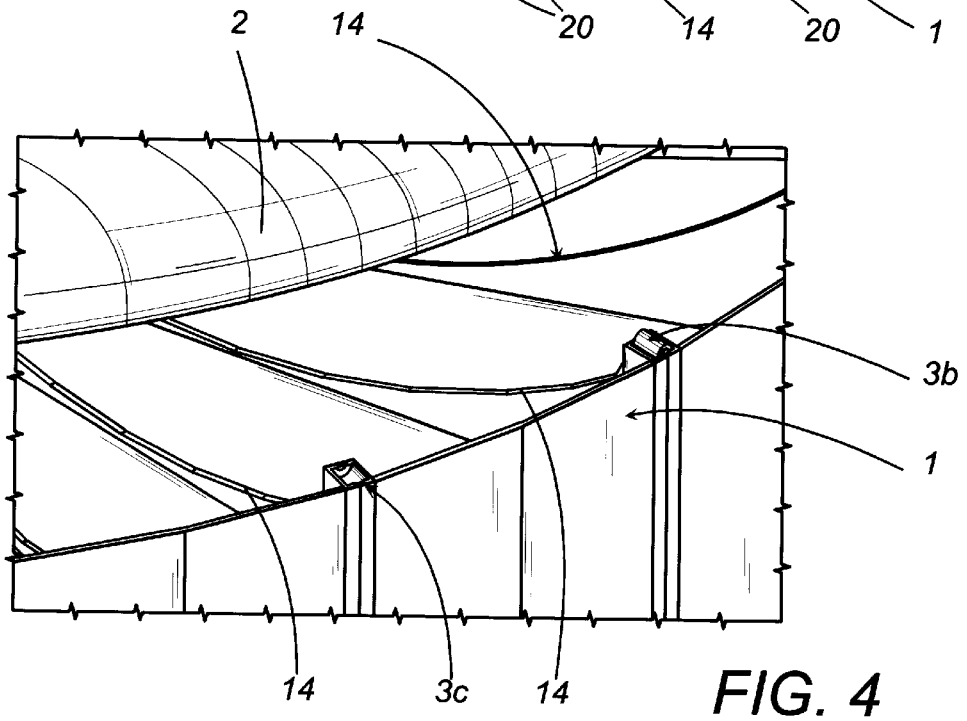
FIG. 4

REVOLVING SUNNING BED

BACKGROUND OF THE INVENTION

The present invention relates to a revolving sunning bed.

The number of beach areas provided with beach guards and equipped to offer tourists each of the comforts they desire is continuously on the rise. In particular, the beaches of Romagna's riviera in Italy have always shown to be at the leading edge in the field of such equipment.

Thus, for several decades now these beaches have been offering aerial views in which one may observe, between the sea and the road, the unfolding of a multi-covered stream made up of umbrellas and beach chairs of various shapes and sizes.

For about twenty years, the type of beach chair most in demand has surely been the so-called "bed". It is made up of a frame similar to that of a single bed with two pairs of feet, front and rear, and a tiltable head support at one end: to the upper edges of the frame is fastened a strip made of cloth or plastic material which allows persons to lie thereon. In correspondence with the head support is applied a tiltable sun shield which allows, if desired, to keep one's head in the shade.

Over the years, the material used to construct the frame has changed, from wood to aluminum, but the shape has remained unvaried.

Although the bed allows a much more complete exposition to the sun than the lounge chairs or beach chairs used previously, it nevertheless does not remove the annoying need occasionally to be rotated in order to stay exposed to the sun and allow the user to obtain the best tan.

Even remaining on the beach a few hours, an optimal exposure requires the bed to be moved several times and it forces the tourist repeatedly to get up.

Moreover, while always remaining in the position most irradiated by the rays of the sun, it is still not possible to have a uniform tan and the risk of burns increases.

SUMMARY OF THE INVENTION

The purpose of the present invention is therefore to eliminate the drawbacks mentioned above. The invention, as it is characterized by the claims, solves the problem of obtaining the preferred exposure to the rays of the sun while lying down comfortably.

One of the advantages obtained by means of the present invention consists essentially of the fact that the annoyance of having to stand up to position the bed manually is eliminated. Moreover, it allows to obtain a uniform and complete tan over all one's body.

Lastly, all exposed parts can easily be constructed with materials which are not subject to wear due to atmospheric factors.

BRIEF DESCRIPTION OF THE DRAWINGS

The technical characteristics of the invention, according to the aforesaid purposes, can clearly be seen from the content of the claims reported below and its advantages shall be made more evident in the detailed description that follows, made with reference to the enclosed drawings, which show an embodiment provided purely by way of non-limiting example, in which:

FIG. 2 shows the invention according to a plan view from above;

FIG. 3 shows the invention according to section III—III as per FIG. 2;

FIGS. 4 and 5 show constructive details of the invention.

DESCRIPTION OF THE PREFERRED EMBODIMENTS

Figure 1:
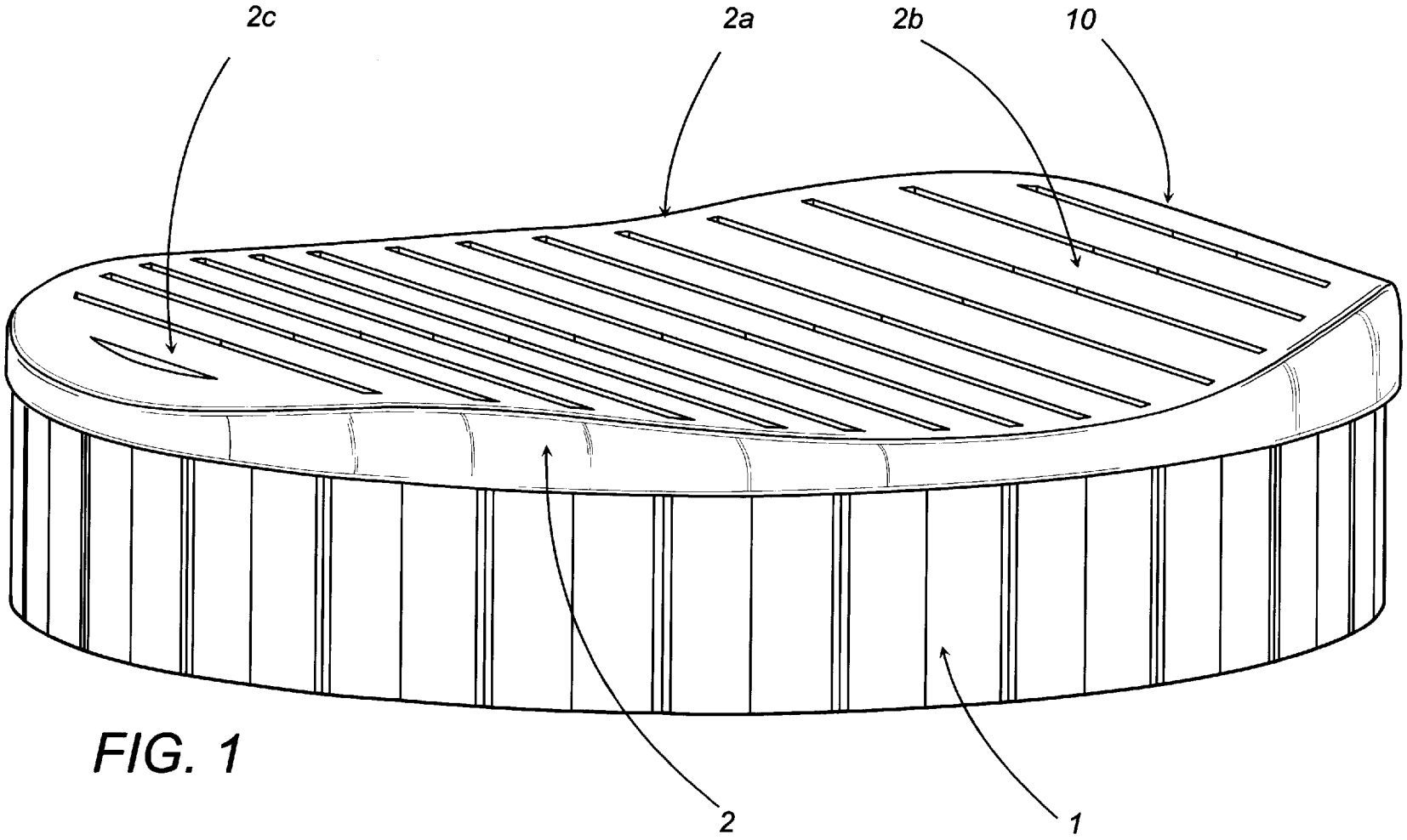
FIG. 1 shows the invention in a prospective view.

The invention relates to a revolving sunning bed comprising a fixed support base (1), a revolving platform (2) and means of mutual constraint (3) interposed between the support base (1) and the platform (2) able to allow the platform (2) to revolve with respect to the support base (1).

Motion of the platform (2) is provided by a motor-driven device (5), advantageously contained in a waterproof space (6) within the support base (1). By way of example, as is schematically shown in FIG. 3, the motor-driven device (5) comprises a motor and a reduction gear with a small pulley made of non rigid material, so that under the weight of the platform (2) there is a slight compression and a consequent increase in the contact surface area.

On the platform (2) itself is a command and control device (5*a*), easily accessible even by a person lying down on the bed (10), able to regulate the operation of the motor-driven device (5) for imparting motion to the platform (2).

Although the shape of the bed (10) is not at all constraining, the embodiment shown in the Figures refers to a support base (1) and to a platform (2) which are both circular. The support base (1) presents radial ribs (14), whose profile can be seen in FIG. 3, and an edge (15) wherein are obtained seats (3*c*) for rollers (3*b*) with radial axis, shown in FIG. 4.

The central part of the support base (1) is occupied by a centering pin (3*a*), which contributes to the correct position of the revolving platform (2). It comes in contact and is supported by the aforesaid rollers (3*b*) which, protruding from their seats (3*c*), allow for a significant reduction in friction.

Also in proximity to the centering pin (3*a*) it is advantageous to apply an anti-friction device (9), which acts simultaneously both in radial direction, in a manner similar to the aforesaid rollers (3*b*), and in axial direction to minimize friction between the platform (2) and the centering pin (3*a*).

As can be observed in FIG. 3, the platform (2) is slightly wider than the support base with an edge (16) which prevents water from penetrating within. The upper surface (2*a*) is anatomically shaped and within it two convex areas (2*b*, 2*c*) can be distinguished, able to render the outstretched position of a user more comfortable. In particular, in correspondence with the area (2*b*) with smaller radius of curvature, the bed (10) can be provided with a back support with adjustable inclination, commanded by a corresponding command and control device (7*a*).

In a preferred embodiment, which can be seen in FIGS. 2, 3 and 5, the back support (7) is internally hollow in order to house a storage compartment (11). The back support (7) is constrained to the rest of the platform (2) by means of a hinge (12), which allows both for its overall rotation by acting upon the aforesaid command and control device (7*a*), and for its manual opening to gain access to the storage compartment (11).

In the same Figures one can note the presence of an adjustable sun shield (8), which can also be activated remotely by a corresponding command and control device (8*a*), which, for the sake of convenience, can be associated to the others in a single push-button panel (19). Shaped as a spherical canopy, it allows to repair from the sun a part of the body regardless of the inclination of the back support (7). This is obtained with unilateral fastening means (13) which allow to fasten the sun shield (8) to the back support (7), in such a way that when the latter moves it also carries the sun shield (8) with it, but not vice versa.

For the correct operation of the sun shield (8), it is convenient for it to be contained in a hollow space (17) delimited by the outer wall of the back support (7) and a bulkhead (18) constrained at the bottom to the wall itself.

Since the mechanism for moving the sun shield (8) is located in one or more areas, to reduce friction and support the thrust of the driving elements, the bulkhead (18) presents an indented inner surface to provide housing for thrust bearing spheres (20).

The invention thus conceived can be subject to numerous modifications and variations, without thereby departing from the scope of the inventive concept. Moreover, all components may be replaced with technically equivalent elements.

In practice, modifications and/or improvements are obviously possible, remaining within the scope of the claims which follow.

I claim:

1. A revolving sunning bed, comprising:

a fixed support base delimited by a peripheral edge and reinforced by a plurality of radially disposed ribs, each of said ribs having at least one end, which said end terminates in a seat for receiving a roller bearing therein, said base including a central part;

a platform rotatable about an axis, said platform having a back support with adjustable inclination, said back support having an internal hollow that functions as a storage compartment;

means for mutual constraint interposed between said support base and said platform, said means for mutual constraint comprising a centering pin integral with said support base and radial sliding rollers, said centering pin coincidental with said central part of said base and said axis of rotation of said platform;

a motor-driven device for imparting motion to said platform, said motor-driven device disposed within a water-proof inner compartment of said support base;

wherein each of said roller bearings received within said seat is contiguous to said edge of said base so as to provide axial rotation to said platform about said centering pin.

2. The sunning bed according to claim 1, further comprising an adjustable sun shield, said sun shield carried by said back support.

3. The sunning bed according to claim 1, further comprising an adjustable sun shield fastened to said back support, said sun shield carried by said back support when said support is in motion.

4. The sunning bed according to claim 1, wherein the said platform presents an anatomically shaped upper surface.

5. The sunning bed according to claim 4, wherein the said upper surface comprises two convex areas.

6. The sunning bed according to claim 1, further comprising a command and control device for regulating the operation of the motor-driven device.

7. The sunning bed according to claim 1, further comprising a command and control device, for adjusting the inclination of said back support.

8. The sunning bed according to claim 1, wherein said command and control device regulates operation of the said sun shield.

9. The sunning bed according to claim 1, further comprising an indented hollow space for containing the said sun shield.

10. The sunning bed according to claim 1, further comprising an anti-friction device interposed between the said centering pin and said platform.

11. The sunning bed according to claim 1, further including a hinged constraint interposed between said back support and said platform, thereby providing rotation of the back support with respect to the platform, and for providing an opening of the back support to gain access to the storage compartment.

* * * * *